US011312565B2

(12) United States Patent
Fazekas et al.

(10) Patent No.: US 11,312,565 B2
(45) Date of Patent: Apr. 26, 2022

(54) BAG-ON-VALVE

(71) Applicant: Gábor Fazekas, Budapest (HU)

(72) Inventors: Gábor Fazekas, Budapest (HU); Michael Jufer, Walenstadt (DE); Hans Jürgen Werner, Munich (DE)

(73) Assignee: Gábor Fazekas, Budapest (HU)

( * ) Notice: Subject to any disclaimer, the term of this patent is extended or adjusted under 35 U.S.C. 154(b) by 0 days.

(21) Appl. No.: 17/058,312

(22) PCT Filed: Jun. 5, 2019

(86) PCT No.: PCT/EP2019/064636
§ 371 (c)(1),
(2) Date: Nov. 24, 2020

(87) PCT Pub. No.: WO2019/234095
PCT Pub. Date: Dec. 12, 2019

(65) Prior Publication Data

US 2021/0206560 A1 Jul. 8, 2021

(30) Foreign Application Priority Data

Jun. 5, 2018 (DE) ..... 10 2018 113 356.1

(51) Int. Cl.
*B65D 83/62* (2006.01)
*B65D 83/48* (2006.01)

(52) U.S. Cl.
CPC ..... *B65D 83/62* (2013.01); *B65D 83/48* (2013.01)

(58) Field of Classification Search
CPC .... B65D 83/62; B65D 83/48; B65D 47/2062; B65D 47/2018; B65D 21/14
(Continued)

(56) References Cited

U.S. PATENT DOCUMENTS 4,964,540 A * 10/1990 Katz ..... B65D 83/0061 222/105
5,115,944 A * 5/1992 Nikolich ..... B65D 83/62 222/94
(Continued)

FOREIGN PATENT DOCUMENTS

EP 0471503 A2 2/1992
EP 2634111 A1 9/2013
JP S63281977 A 11/1988

*Primary Examiner* — Vishal Pancholi
(74) *Attorney, Agent, or Firm* — Brooks Kushman P.C.

(57) ABSTRACT

Bag-on-valve for a pressurized container, in particular pressurized cans (40), for dispensing viscous to pasty products, comprising a valve disk (3), a valve body (6) arranged on the valve disk (3), a stem (5) guided in a central cutout of the valve body (6), with at least one inlet opening (9) for the product contained in the bag (30), said opening being opened by actuating the stem, at least one outlet opening (10), an elastic element (8) acting on the stem (5), sealing elements (12) acting between valve disk (3) and valve body (6) and between valve body (6) and stem (5) as well as a bag (30) arranged on valve (1) for the product to be discharged through the valve (1), wherein the bag (30) is fixed to a retaining element (2) which has a central passage (23), said retaining element (2) having a laterally extending retaining plate (22) which is connected in a tightly sealing manner to a collar (7) of the valve body, said collar extending vertically on the can side.

15 Claims, 4 Drawing Sheets

(58) Field of Classification Search
USPC ..... 222/212
See application file for complete search history.

(56) References Cited

U.S. PATENT DOCUMENTS

| | | | | |
|---|---|---|---|---|
| 7,455,199 | B2 * | 11/2008 | Cookings | B65D 83/20 222/389 |
| 2008/0116228 | A1 * | 5/2008 | Ryan | B65D 83/663 222/386.5 |
| 2010/0001020 | A1 | 1/2010 | Ashley | |
| 2010/0044400 | A1 * | 2/2010 | Laidler | B65D 83/44 222/402.1 |
| 2010/0051653 | A1 * | 3/2010 | Miller | B65D 83/425 222/402.16 |
| 2010/0320230 | A1 | 12/2010 | Yoon | |
| 2012/0043353 | A1 * | 2/2012 | Davideit | B65D 83/62 222/402.1 |
| 2012/0292338 | A1 * | 11/2012 | Smith | B65D 83/62 222/95 |
| 2013/0284759 | A1 * | 10/2013 | Teramoto | B65D 83/20 222/94 |

* cited by examiner 10
11
5
8
4
9
3
14
12
6
13
X
1
7
25
24
22
21
2
26
23

29
25
27
22
28
26
2
21
23

BAG-ON-VALVE

The invention relates to a bag-on-valve for a pressure container, in particular pressurized cans, for dispensing viscous to pasty products, with the valve comprising a valve disk, a valve body arranged on the valve disk, a stem guided in a central cutout of the valve body and having at least one inlet opening for the product contained in the bag, said opening being opened by actuating the stem, at least one outlet opening, an elastic element acting on the stem, sealing elements acting between the valve disk and the valve body and between the valve body and the stem, as well as a bag arranged on the valve for the product to be discharged through the valve. The invention further relates to a pressurized can provided with such a bag-on-valve.

Pressurized cans for dispensing viscous to pasty substances have long been known and are widely used. Relevant applications can be found, for example, in the food sector (cake decoration), for hygiene products (toothpaste) and for cosmetics. For this purpose, piston cans are frequently employed, in which a piston separates the pressurized can into an upper and a lower part, with the product to be dispensed being located in the upper part, underneath the valve, and a propellant gas being located in the lower part, underneath the piston and above the bottom of the can. With this type of pressurized cans, the often insufficient separation of product and propellant on the one hand is a source of problems, while on the other hand the introduction of both the product and the propellant is a complex and time-consuming process. In particular, a second valve arranged in the bottom of the can is needed through which the propellant is to be injected. The second valve and the piston as well as the filling/injecting systems and devices result in the cans and the product being considerably more expensive.

As an alternative solution bag-on-valve cans can be employed. In such bag-on-valve cans the product is kept separately from the propellant. If the bag is fixed to the can body, the same problems arise when filling in propellant as with the piston can described hereinbefore. Arranging the bag on the valve, requires the product to be filled through the valve, which is both time-consuming and expensive and at the same time causes valve contamination. As a result of the design of the valve systems, the charging speed is limited. The injection of the propellant requires either a special main valve design or the arrangement of a second valve in the can bottom. Such bag-on-valve cans are unsuited for products having a viscosity exceeding 50 Pas. They are employed for instance with shaving gels.

It is thus the objective of the present invention to provide a pressurized can by means of which viscous and pasty substances that are stored in a bag, can be discharged with the aid of a propellant. Such a bag-on-valve can should be inexpensive to produce, easy to fill and safe to handle.

This objective is achieved by providing a bag-on-valve of the kind first mentioned above, wherein the bag is fixed to a retaining element which has a central passage, said retaining element being equipped with a laterally extending retaining plate which is connected in a tightly sealing manner to a collar of the valve body, said collar extending vertically on the can side. Moreover, the objective is reached with a pressurized can equipped with such a bag-on-valve.

The bag-on-valve proposed by the invention avoids the disadvantages of the associated state of the art. First of all, the product and the propellant are safely separated from each other as desired. Moreover, the special design of the valve provided with a retaining element enables the bag to be filled with a product, even inside the pressurized can, before the valve is mounted and the pressurized can is charged with propellant. Customary pressurized cans can be used, which only must be equipped with the bag-on-valve proposed by the invention.

The terms "valve side" and "can side" as they are used herein refer—in the vertical direction—to an orientation towards the valve or towards the inside of the can. Likewise, the terms "inwards" and "outwards" of the can—in the horizontal plane—denote an orientation towards the can rim or the can axis.

The bag-on-valve proposed by the invention is derived from a customary solid material valve intended for the discharge of polyurethane-based expanding foams, as described for example in publications EP 2 028 131 A1 and EP 3 044 123 A1.

The bag-on-valve according to the invention is designed and suitable for dispensing viscous to pasty products from a pressurized can with the aid of a propellant. Its design is based on a customary solid material valve which is modified to suit this purpose. Such a solid material valve is usually made of a polyalkylene, e.g. polypropylene, by an injection molding process. The customary portion of the valve consists of a valve disk, a valve body arranged on the valve disk, said valve body having a central passage in which a stem is guided, wherein the valve is provided with an inlet opening for the bag contents which can be opened by actuating the stem. The valve is actuated in particular by pressing down the stem. An elastic element connected to the stem causes the valve to return to its closed state after actuation. Sealing elements are arranged between valve disk and valve body and between valve body and stem.

The product containing bag is mounted at the can side end of the valve. For this reason, the valve body is provided with a circumferential collar on the can side, which extends beyond the can side end of the stem. The bag is mounted on a retaining element having a central passage and being connected to the collar by a retaining plate extending laterally (outwards of the can). The connection is gas- and liquid-tight.

The retaining plate of the retaining element can be glued or welded to the valve collar. For example, the connection can be made by ultrasonic welding (HF welding). Preferably, however, a snap-in or snap-on connection is to be used that allows the retaining plate with already mounted bag to be easily snap locked to the collar of the valve. It goes without saying that a sealing element must be arranged between the retaining plate and the collar.

For example, a latching or snap-on connection can be established by arranging a projection on the outside of the circumferential collar of the valve body and latching hooks located on the periphery of the retaining plate. The design principle of such snap-in or latching connections is known per se. The latching or snap-in connection is designed so as to be permanent; a separation of valve and retaining plate is not intended.

The required seal may, for instance, be brought about by an O-ring, which is arranged in a seating arrangement on the periphery of the holding plate and thus provides sealing action at the can-side end of the collar. In this context, the can side end of the collar can be beveled inwards in such a way that the bevel points to the can axis and the O-ring provides a seal against this bevel.

Such a bevel makes sure that a particularly effective and permanent contact is achieved between the seal and the collar of the valve body, which offers protection against loss of propellant during storage of a filled pressurized can. Accordingly, an advantage of the pressurized can proposed by the invention is thus the minor loss of propellant during shelf time and service life of the can.

As an alternative, the required seal may also be provided by arranging a sealing element molded or injection-molded onto the outer rim of the retaining plate, said element may consist, for example, of a thermoplastic elastomer (TPE). Such plastic products consisting of two different materials can be produced for instance by adopting a two-component injection process.

When using an injection-molded sealing element, the sealing effect is also brought about by the close and leak-tight contact between the retaining plate and collar. The can-side edge of the collar can also be beveled inwards, as described hereinbefore with respect to the O-ring.

The product bag is attached to a central spigot of the retaining element. It shall be understood that the central bore of the retaining element extends through this spigot. The spigot proper can be round but may as well have any other shape that is compatible with the intended use, for example it may be polygonal, especially four-square, diamond-shaped or drop-shaped. The attachment is achieved in particular by gluing or welding, for example by ultrasonic welding. A horizontal circumferential filling of the spigot is advantageous, especially during assembly.

The bag itself is preferably fabricated of plastic material and designed so as to comprise several layers. The multi-layer design increases the tear resistance and prevents the bag from tearing off the retaining element after filling. With a view to improving the bag's tightness, it is of course possible to use composite materials consisting of several plastics or make use of aluminum. It is also conceivable to provide the bag with a metallized plastic sheet.

The valve part of the bag-on-valve within the scope of the invention is essentially designed as described in publication EP 2 028 131 A1. The valve body is provided with a groove around the stem in which the elastic element is arranged. The elastic element embraces the stem and provides an additional sealing effect achieved at the stem and in addition has springiness characteristics (resilience force exerted after actuation of the valve). For this purpose, the elastic element preferably consists of a thermoplastic elastomer (TPE). As an alternative, a coil spring can be used. Particularly recommendable is also a combination of coil spring and thermoplastic elastomer. A retaining ring consisting of resistant plastic material such as polyoxymethylene serves as an abutment for the elastic element at the valve side end of the stem.

The invention further relates to pressurized containers, in particular pressurized cans equipped with such a bag-on-valve. The propellant used in such pressurized cans can be, for example, nitrogen or another inert gas, air or even a customary propellant gas, for example a liquefied petroleum gas or a liquefied petroleum gas mixture (propane, butane, dimethyl ether).

The bag-on-valve the invention proposes enables in particular pressurized cans to be very efficiently filled. For this purpose, the retaining element is attached to the bag, ultrasonically welded with the bag then being suspended in the pressurized can which is still open at the top. The retaining element remains outside the pressurized can. The bag is now ready to be filled. After filling, the retaining plate of the combination comprising retaining element and filled bag is connected to the collar of the valve, for example by latching or ultrasonic welding. Following this, the pressurized can is filled with propellant under a pressure bell at a pressure ranging between 2 and 14 bar, and, while still under the pressure bell, the valve disk is crimped to the can dome. After labelling and packaging the can is ready to be dispatched.

The invention is explained in more detail by way of the enclosed figures showing preferred embodiments. It is to be understood that the characteristic features illustrated in the figures form part of the invention in any conceivable technical context.

Elucidation of the invention is provided by the following figures where

Figure 9:
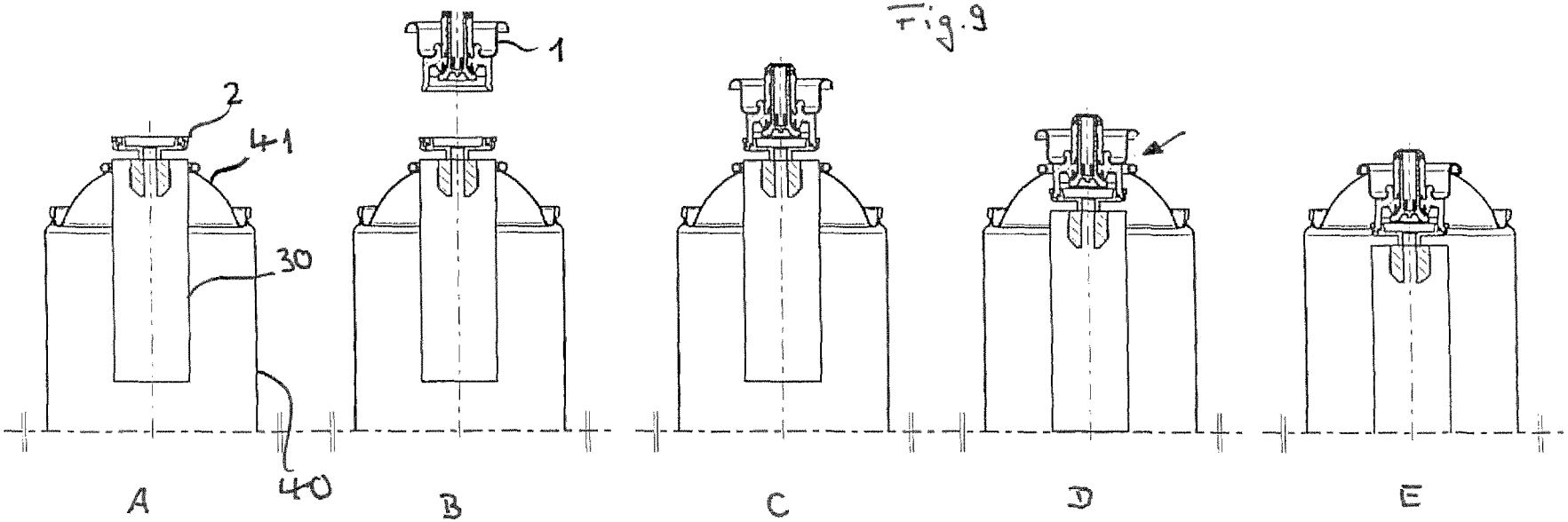

FIG. 9 schematically illustrates the steps involved in assembling the pressurized can and bag-on-valve including filling.

Figure 1:
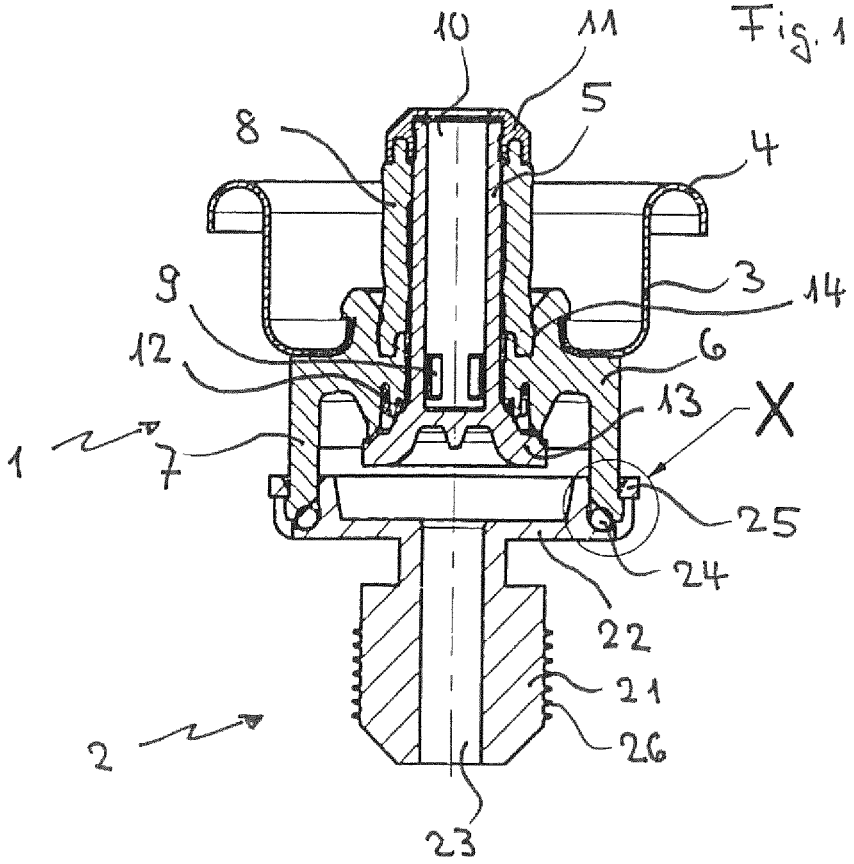
FIG. 1 is a general view of a bag-on-valve with the bag not being shown.

FIG. 1 shows a bag-on-valve according to the invention without the bag being mounted. The actual valve is marked with reference numeral 1, the retaining element for the bag has numeral 2. The valve 1 consists of the valve disk 3 with the crimping rim 4, the stem 5, the valve body 6 with a downwardly extending collar 7 oriented towards the can side, and the elastic element 8, which in this case is a sleeve fabricated of a thermoplastic elastomer arranged around the stem 5. At its can side end 2, the stem 5 has several inlet openings 9 and an outlet opening 10 at the valve side end. In the area of the outlet opening 10 there is a plastic sleeve 11, which serves as upper abutment for the elastic element 8. The lower or can side end of the elastic element 8 supports itself in an annular groove of the valve body 6.

Valve body 6 has a base 13 which extends sideways in the form of a ring and seals the stem against the valve body 6. There are sealing lips 12 in the contact area between the valve base 13 and the valve body 6. Alternatively, an O-ring can be arranged, which is located in a groove of the valve body 6 or stem 5. Moreover, the valve body may also be provided with an injection molded sealing element made of a thermoplastic elastomer (TPE, two-component molding).

The valve body 6 is mounted on and attached to the valve disk 3 in a well-known manner.

The retaining element 2 comprises a retaining spigot 21 and a retaining plate 22, which are concentrically arranged around a passage 23. The retaining plate 22 extends sideways towards the edge or rim of a surrounding pressurized can and is attached to the collar 7 of the valve body 6 via a sealing ring 24 and latching elements 25, refer to detail X.

The retaining spigot 21 itself can be of optional shape, but appropriately has an elongated diamond shape, that is, roughly similar to the shape of a ship. It is provided with circumferential fins 26, which serve to improve fit and fixation of an assembled bag.

For the removal of bag contents, the bag-on-valve proposed by the invention is actuated by pressing down the stem 5 using a conventional adapter. After removal of bag contents is completed, the elastic element 8 ensures the closed position of the valve is restored. The valve can be actuated again until the bag has entirely been emptied.

Figure 2:
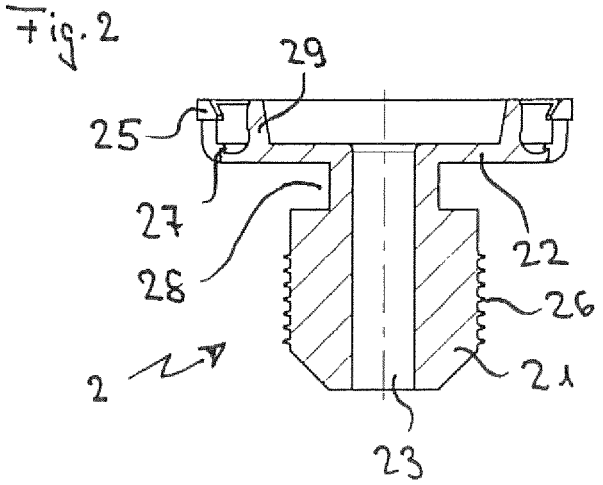
FIG. 2 shows a detailed view of the retaining element.

In FIG. 2 a variant of the inventive retaining element 2 can be seen showing the retaining spigot 21 and the retaining plate 22. In the center of the retaining element 2 there is a passage 23 through which the contents of the bag are filled into and discharged from the bag. Around the pivot 21 fins 26 are arranged horizontally. To facilitate insertion into a pressurized can and for the fixation of a bag, spigot 21 is tapered at its can-side end, that is, the side faces are beveled.

Above the spigot 21 a constriction 28 is provided, which can serve as a holding aid when filling a mounted bag. Within the retaining plate 22 there is a seat 27 for the accommodation of an O-ring, circumferentially arranged latches 25 to secure the retaining element to the collar 7 of the valve body 6 and, on the inside, an upright rim 29 that extends towards the valve side and is provided with a view to improving the connection of the retaining element to the collar 7 of the valve disk 6.

Figure 3:
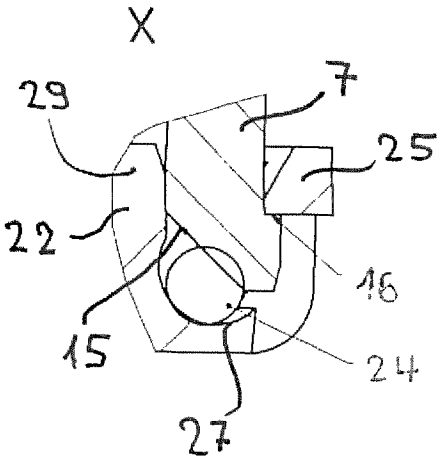
FIG. 3 illustrates a detailed view of the connection of the retaining element and valve collar.

FIG. 3 depicts detail X from FIG. 1 showing the collar 7 protruding from valve 1 downwards towards the can side, the retaining plate 22 with its protruding upright rim 29 and the seat 27 for the accommodation of an O-ring 24. The O-ring 24 is located in the seat 27 of the retaining plate 22 and supports itself on valve 1 in the area of the collar 7 on a beveled surface 15, the inclination of which facing inwards. The collar 7 also has a circumferential projection 16 on its outside (facing outwards from the can), behind which the latching elements 25 of retaining element 2 engage. The secure and immovable seating of the latching elements 25 at the projection 16 is ensured by the upright rim 29 of the retaining plate 22, which abuts directly against the inner wall of the collar 7.

Figure 4:
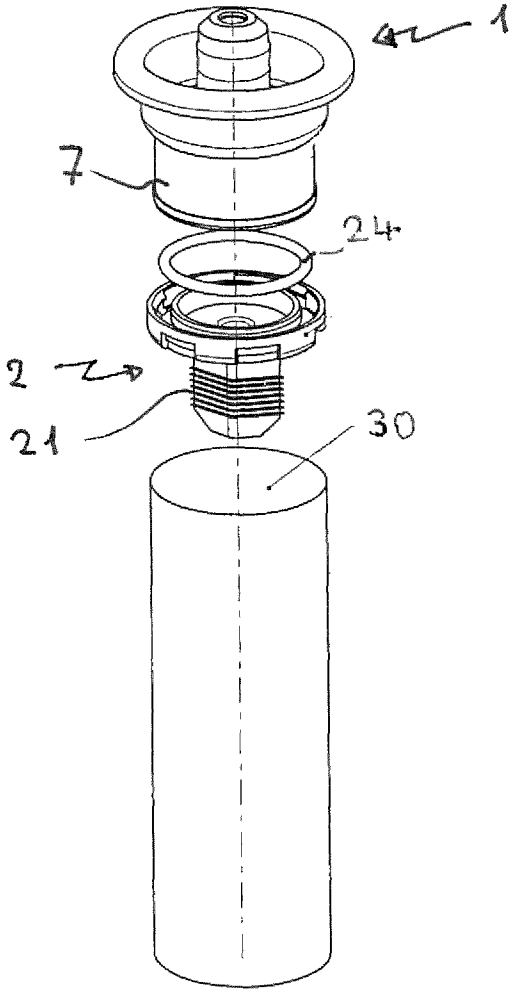
FIG. 4 shows the individual elements of the bag-on-valve according to FIGS. 1 to 3.

FIG. 4 shows in an overview the individual elements of FIGS. 1 to 3 together with a bag 30. Valve 1 with collar 7 is latched to the retaining element 2 with O-ring 24 being arranged in between. The bag 30 is attached to spigot 21 of the retaining element 2.

In the variant of the inventive bag-on-valve shown in FIGS. 1 to 4, the valve body consists of HDPE, while the retaining element is made of PP and the bag is built up of several layers of PE.

Figure 5:
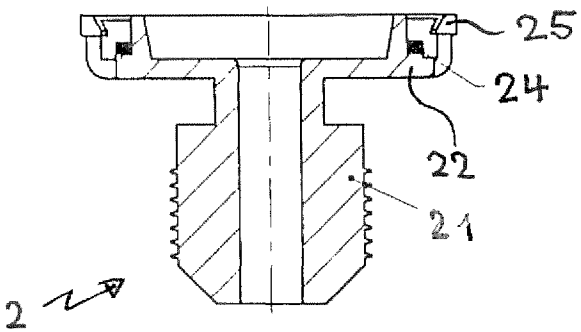
FIG. 5 shows a second variant of the retaining element with molded-on TPE seal.
Figure 6:
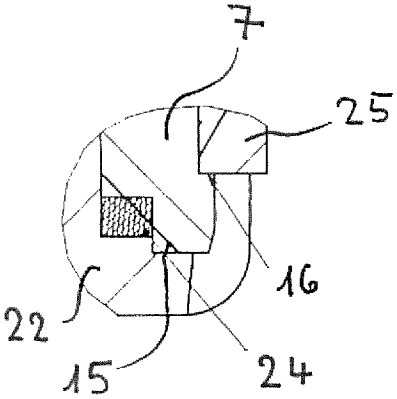
FIG. 6 is a detailed view of the connection of the retaining element to the valve collar as shown in FIG. 5.

Illustrated in FIGS. 5 and 6 is another variant of the seal arranged between valve 1 and retaining element 2. The seal 24 consists of a sealing ring of thermoplastic elastomer material injection-molded onto the retaining plate 22 by adopting a two-component process, said ring acting as a seal against the bevel 15 of the collar 7 of valve 1, as shown in FIG. 6. The sealing principle incidentally corresponds to the principle shown in FIGS. 2 and 3.

Figure 7:
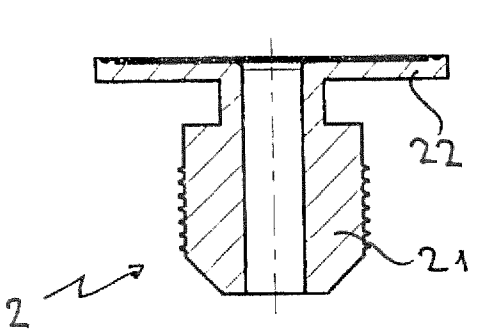
FIG. 7 illustrates a third variant of the retaining element.
Figure 8:
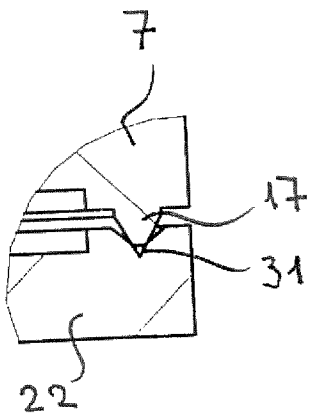
FIG. 8 is a detailed view of the connection of the retaining element to the valve collar as shown in FIG. 7.

From FIGS. 7 and 8 a third variant of a seal arranged between valve 1 and retaining element 2 can be seen. In this case, the sealing element is replaced by a welded joint by means of which a circumferential outer groove 31 of the retaining plate 22 is connected to a circumferential projection 17 of the collar 7 of valve 1. In this variant, the material of valve 1 should, expediently, be identical to the material of retaining element 2, for example should be HDPE. The connection is preferably made by ultrasonic welding.

FIG. 9 is a schematic representation of the assembly principle for a pressurized can equipped according to the invention. In the first step A, the bag 30, which is already attached to the retaining element 2, is hung into a pressurized can 40 with a dome 41 in such a way that the retaining plate 2 is still positioned outside the dome. The bag 30 is filled through the passage provided in the retaining element 2. In the second step B, the valve 1 is snapped onto the retaining element 2. The bag-on-valve is lowered further into the can, but is not yet attached to the can dome 41 (C). Propellant (arrow) is now introduced into the can via a pressure bell (D) and, while still under the bell, the bag-on-valve is attached to the can dome by crimping (E).

This special method is based on customary pressurized cans as they are used for numerous applications in industry, trade and household. The bag 30 does not need to be filled through the valve, but the bag contents are introduced through the passage provided in the retaining element. Only when this has been completed will the bag 30 be tightly closed by clipping on valve 1. When propellant is now filled into the can, no propellant is capable of ingressing into the bag 30.

Filling the bag through the stem of the valve is also possible, but makes it necessary that the stem has to be cleaned afterwards. Filling the can through the valve is usually required in the event the valve and retaining element are connected by welding.

The use of a solid material valve, as it is known from the state of the art for polyurethane foam cans, offers the advantage that the bag can be filled and emptied in a very short time via the relatively large cross-section of the stem. This is especially advantageous when the need arises to fill the bag through the stem.

The bag-on-valve proposed by the invention and pressurized cans equipped with it can be utilized for a plurality of viscous and pasty products. In the food sector, these may include, for example, honey, cake decorations, cheese, dough, fat, pudding, creams. In the hygiene sector, toothpaste and soap are suitable products. In the cosmetics sector as well as in the medical field, the valve may be used for creams and ointments. Examples for technical applications include sealing compounds, grease and pastes.

The invention claimed is:

1. Bag-on-valve for a pressurized can (40), for dispensing viscous to pasty products, comprising a valve disk (3), a valve body (6) arranged on the valve disk (3), a stem (5) guided in a central cutout of the valve body (6), with at least one inlet opening (9) for the product contained in the bag (30), said opening being opened by actuating the stem, at least one outlet opening (10), an elastic element (8) acting on the stem (5), the stem (5) being provided with a retaining ring (11) at its outlet opening (9) serving as an abutment for the elastic element (8), the lower end of the elastic element (8) oriented towards the side of the can being supported in an annular groove of the valve body (6), sealing elements (12) acting between valve disk (3) and valve body (6) and between valve body (6) and stem (5) as well as a bag (30) arranged on valve (1) for the product to be discharged through the valve (1), characterized in that the bag (30) is fixed to a retaining element (2) which has a central passage (23), said retaining element (2) having a laterally extending retaining plate (22) which is connected in a tightly sealing manner to a collar (7) of the valve body, said collar extending vertically into the can.

2. Bag-on-valve according to claim 1, characterized in that the retaining plate (22) and the collar (7) are attached to one another by means of a snap-in or snap-on connection.

3. Bag-on-valve according to claim 2, characterized in that the collar (7) has a circumferential outer projection (16) in which latches (25) engage or interlock that are arranged on the retaining plate.

4. Bag-on-valve according to claim 1, characterized in that a sealing element (24) is arranged between retaining plate (22) and collar (7).

5. Bag-on-valve according to claim 4, characterized in that the sealing element (24) is an O-ring (24) arranged in a peripheral seating arrangement (27) of the retaining plate, said O-ring providing a seal against the wall (15) at the end of the collar (7) in an orientation towards the inside of the can.

6. Bag-on-valve according to claim 4, characterized by a molded-on sealing element (24) located in the peripheral area of the retaining plate (22), said element providing a seal against the wall (15) at the can side end of the collar (7) in an orientation towards the inside of the can.

7. Bag-on-valve according to claim 6, characterized in that the sealing element (24) consists of a thermoplastic elastomer (TPE).

8. Bag-on-valve according to claim 5, characterized in that the end of the collar (7) in said orientation towards the inside of the can is beveled, with the bevel (15) pointing inwardly towards the can in the direction of the sealing element (24) of the retaining plate (22).

9. Bag-on-valve according to claim 1, characterized in that the retaining element (2) is provided with a central spigot (21) directed towards the inside of the can serving for the fixation of the bag (30).

10. Bag-on-valve according to claim 9, characterized in that the bag (30) is glued or welded to the spigot (21).

11. Bag-on-valve according to claim 1, characterized in that the bag (30) is designed so as to comprise several layers.

12. Bag-on-valve according to claim 1, characterized in that the valve body (6) has a circumferential groove (14) around the stem (5) in which the elastic element (8) surrounding the stem (5) is arranged.

13. Bag-on-valve according to claim 12, characterized in that the elastic element (8) is formed of a thermoplastic elastomer, a coil spring or a combination thereof.

14. Pressurized can provided with a bag-on-valve according to claim 1.

15. Use of a bag-on-valve according to claim 1 for dispensing viscous or pasty products from a pressurized can (40).

* * * * *